United States Patent [19]

Long

[11] 4,121,069

[45] Oct. 17, 1978

[54] SNAP-ACTION ELECTRIC SWITCH WITH FULCRUM MEANS FOR LIMITED CONTACT SLIDING AND POSITIVE-OFF TORQUE

[75] Inventor: Eric L. Long, Mequon, Wis.

[73] Assignee: Cutler-Hammer, Inc., Milwaukee, Wis.

[21] Appl. No.: 715,898

[22] Filed: Aug. 19, 1976

[51] Int. Cl.[2] ..... H01H 5/06

[52] U.S. Cl. ..... 200/67 A; 200/67 G; 200/77

[58] Field of Search ..... 200/157, 77, 68, 76, 200/67 G, 339

[56] References Cited

U.S. PATENT DOCUMENTS

| | | | |
|---|---|---|---|
| 3,600,533 | 8/1971 | English | 200/77 |
| 3,775,576 | 11/1973 | Brown | 200/157 |
| 3,869,590 | 3/1975 | Hults | 200/157 |

*Primary Examiner*—Samuel W. Engle
*Assistant Examiner*—Ralph Palo
*Attorney, Agent, or Firm*—Hugh R. Rather; William A. Autio; Michael E. Taken

[57] ABSTRACT

An electric snap-action switch is disclosed having a movable contactor with oppositely inclined camming surfaces meeting at an apex on the top thereof. The contactor is centrally biased upwardly from below and cammed downwardly from above by a laterally movable operator traversing the inclined camming surfaces such that the contactor snaps laterally against vertical stationary contacts as the apex is crossed by the operator. The invention includes fulcrum means effective to stop the downward movement of the contactor before the operator crosses the apex whereby a moment arm is formed from a fulcrum to the point of operator-contactor engagement such that further movement of the operator towards the apex effectuates a torque on the contactor to pivot the contactor about the fulcrum to positively break any welds or other frictional attachments between the contacts without relying on the stored energy of the carrier biasing means, thereby affording a switch having little possibility of failure in an "on" position. The inclined camming surfaces of the contactor may be formed with compound slopes to assure constant operator pressure prior to trip point as the contactor pivots and increases the angle of inclination of the camming surface traversed by the operator. Specific embodiments of a double-pole single-throw trigger switch and a double-pole double-throw toggle lever switch are disclosed.

20 Claims, 17 Drawing Figures

SNAP-ACTION ELECTRIC SWITCH WITH FULCRUM MEANS FOR LIMITED CONTACT SLIDING AND POSITIVE-OFF TORQUE

BACKGROUND OF THE INVENTION

Snap-action switches having a movable contactor propelled by overcenter biasing means are known in the art. These prior switches suffer one or more disadvantages such as: relying on the force or stored energy of only the overcenter biasing means to break contact; too much or too little sliding and wiping of the contact surfaces; butt contact only; limited current carrying ability; limited versatility with respect to operator type, e.g. toggle lever only, or linearly reciprocal trigger only, etc.,; high cost and complexity of design; and only a singular mode of contact action. While these prior switches have been useful for their intended purposes, the present invention relates to improvements thereover.

SUMMARY OF THE INVENTION

An object of the present invention is to provide an improved electric switch.

Another object is to provide a snap-action switch having little possibility of failure in the "on" position.

Another object is to provide a snap-action switch having fulcrum means effective to enable a positive torque to be applied to break the contacts in addition to the contact breaking force applied by the release of stored energy of overcenter biasing means.

Another object is to provide a snap-action switch having butting and sliding contact engagement.

Another object is to provide a snap-action switch having high current carrying capacity.

Another object is to provide a snap-action switch which may utilize various types of operators.

Another object is to provide a snap-action switch of simple design and few parts, and which is inexpensive to manufacture.

Another object is to provide a snap-action switch which is easily adaptable for single and double-pole applications as well as single and double-throw versions.

Another object is to provide a snap-action switch wherein static contact engagement is initially broken by torsion and/or momentary torque and/or shear.

Another object is to provide a snap-action switch having improved common engagement.

A more specific object is to provide a snap-action switch having an upwardly biased apexed movable contactor which is cammed downwardly from above by an operator to snap laterally as the apex is crossed by the operator, and including fulcrum means effective to halt the downward movement of the movable contactor before the operator crosses the apex such that a positive torque is directly applied to the movable contactor by the operator as the operator continues toward the apex whereby to assure disengagement of the contacts.

Another more specific object is to provide a snap-action switch having an upwardly biased apexed movable contactor which is cammed downwardly from above by an operator to snap laterally against vertical stationary contacts in butting and sliding relation on make as the apex is crossed by the operator and wherein static engagement of the contacts is initially broken by torsion and/or momentary torque and/or shear to allow sliding therebetween as the movable contactor is cammed downwardly by the operator, and including fulcrum means effective to halt the downward movement of the movable contactor on break before the operator crosses the apex such that a moment arm is formed to the point of operator-contactor engagement whereby further movement of the operator towards the apex causes the movable contactor to pivot about the fulcrum means away from the stationary contacts, thus providing a positive torque at the end of the downward stroke of the movable contactor to break the contacts and assure snap-action opening thereof as the operator crosses the apex.

Another more specific object is to provide a switch of the aforementioned character having a compound slope leading to the apex on the movable contactor to compensate for the increased operator force necessary when the downward movement of the movable contactor is halted by the fulcrum means as the operator traverses the compound slope towards the apex.

Other objects and advantages will hereinafter appear.

DESCRIPTION OF THE PREFERRED EMBODIMENT

Figure 1:
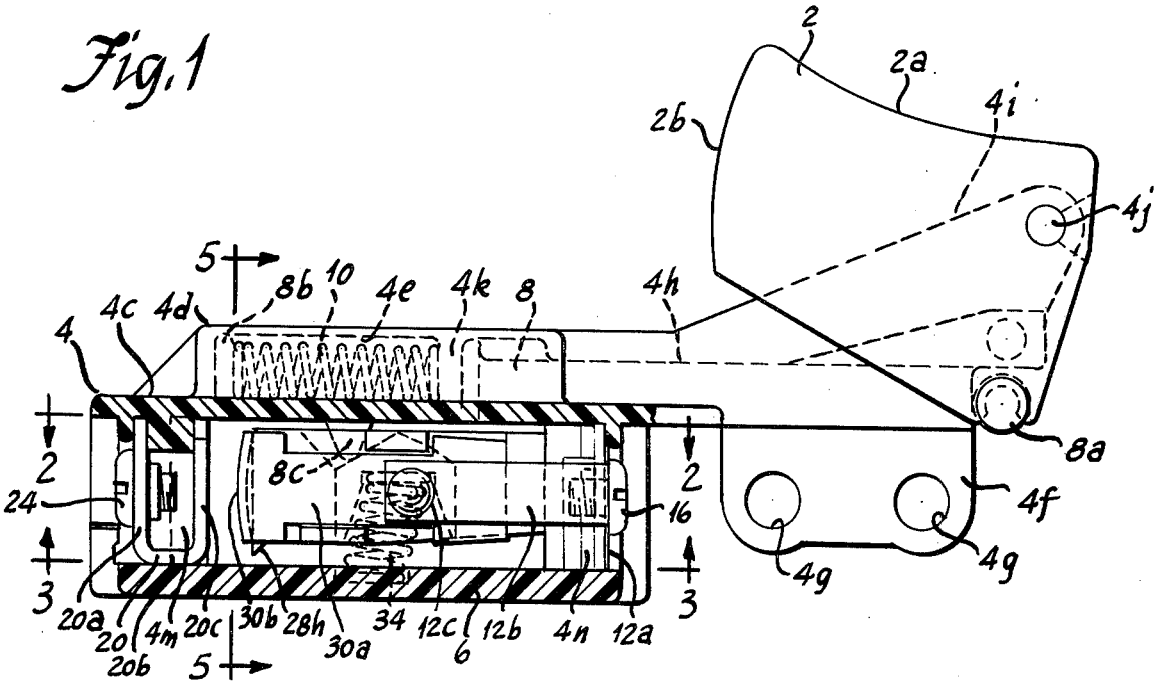
FIG. 1 is a front elevational view of a switch constructed in accordance with the invention, with the front wall removed.
Figure 4:
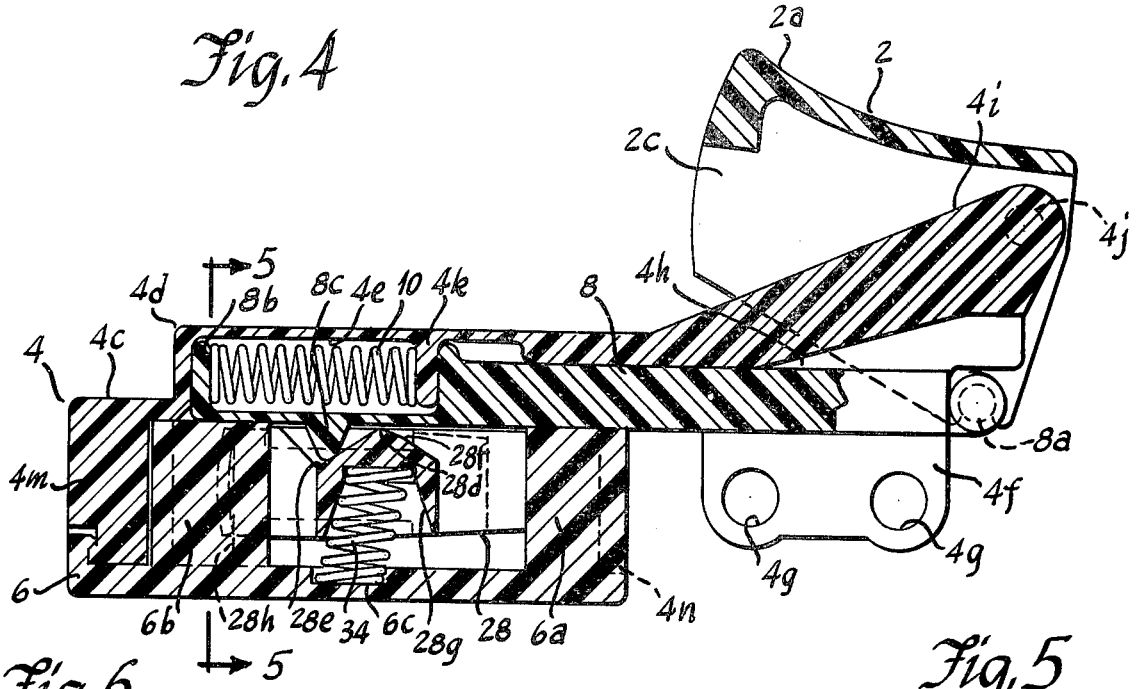
FIG. 4 is a cross-sectional view taken along line 4—4 of FIG. 2.

There is shown in FIGS. 1 and 4 a snap-action electric switch constructed in accordance with the invention and operated by an overhanging trigger 2.

The switch comprises an integral insulating housing 4 open at the bottom and a bottom insulating wall 6 mounted to and closing the housing. The housing has front and back walls **4*a* and 4*b*, FIG. 2. As shown in FIGS. 1 and 4, the housing has a top wall 4*c* with a raised portion 4*d* forming an elongated cavity 4*e*. Top wall 4*c* extends rightwardly and has a downwardly extending flange 4*f* with a pair of apertures 4*g* for mounting in a tool handle, etc. Raised portion 4*d* also extends rightwardly, forming a narrower cavity 4*h* therethrough which receives an elongated rod 8. The right hand end 4*i* of raised portion 4*d* is further raised and has front and rear trunnions 4j for pivotally mounting the trigger 2**.

The trigger has a finger engaging portion 2a with downwardly extending front and rear bifurcations 2b and 2c, respectively, FIGS. 1 and 4. Raised portion 4i extends between these bifurcations, and trunnions 4j extend through apertures in the bifurcations to pivotally mount the trigger thereabout. The lower right hand ends of the bifurcations have apertures for receiving front and rear trunnions 8a integrally formed on the right hand end of rod 8.

Rod 8 extends through narrow elongated cavity 4h for left-right linearly reciprocal sliding movement. Integrally formed on the left hand end of rod 8 is an elongated open-topped box-like portion 8b extending in cavity 4e. Raised portion 4d of the housing has a nub 4k extending downwardly therefrom into cavity 4e partway into box portion 8b. A helical compression spring 10 bears between nub 4k and the left side wall of open-topped box portion 8b to bias rod 8 leftwardly.

As shown in FIG. 4, when portion 2a of the trigger is depressed by the finger of the user, the trigger will pivot counterclockwise about pivot point 4j to pull rod 8 rightwardly by means of trunnions 8a. This rightward movement of rod 8 compresses spring 10, FIG. 6; upon release of the trigger, spring 10 returns rod 8 to its leftmost position with the left side wall of box portion 8b stopped against the left side wall of raised portion, 4d, FIG. 4.

Figure 2:
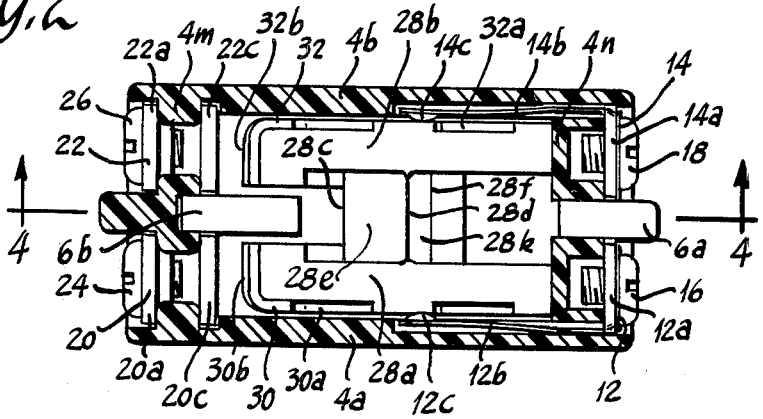
FIG. 2 is a partial cross-sectional view taken along line 2—2 of FIG. 1.

Housing 4 has left and right side walls 4m and 4n for mounting stationary contacts, as will presently be described. Referring to FIGS. 1 and 2, right wall 4n is channeled and grooved for receiving legs 12a and 14a of L-shaped common contact terminals 12 and 14. Screws 16 and 18 are threadably received in legs 12a and 14a respectively for attaching wires or other circuit connection means. The other legs 12b and 14b extend leftwardly interiorly of the housing along front and rear walls 4a and 4b respectively and have rounded inner bumps 12c and 14c for making continuous contact with movable contacts as will be described more fully hereinafter. Legs 12b and 14b are coined and inwardly biased to provide reliable common engagement. Bottom wall 6 has an integral upstanding vertical partition portion 6a extending centrally upwardly from its right hand end between legs 12a and 14a, FIGS. 2 and 4, to provide added isolation therebetween. As seen in FIG. 4, rod 8 rides on top of partition 6a, whereby partition 6a also acts as a guide for the horizontal movement of rod 8.

Left wall 4m is channeled and grooved to receive a pair of U-shaped stationary contacts 20 and 22 mounted from below, FIGS. 1, 2 and 3. Screws 24 and 26 are threadably received in left vertical sides 20a and 22a of the contacts for attaching wires or other circuit connection means. Horizontal bights 20b and 22b rest against bottom wall 6 after assembly. Movable contacts make and break contact with right vertical sides 20c and 22c as will be more fully described hereinafter. Bottom wall 6 has an integral upstanding vertical partition portion 6b extending centrally upwardly from its lefthand end between contacts 20 and 22, FIGS. 2 and 4, to provide added isolation therebetween and to prevent arcing thereacross.

Figure 3:
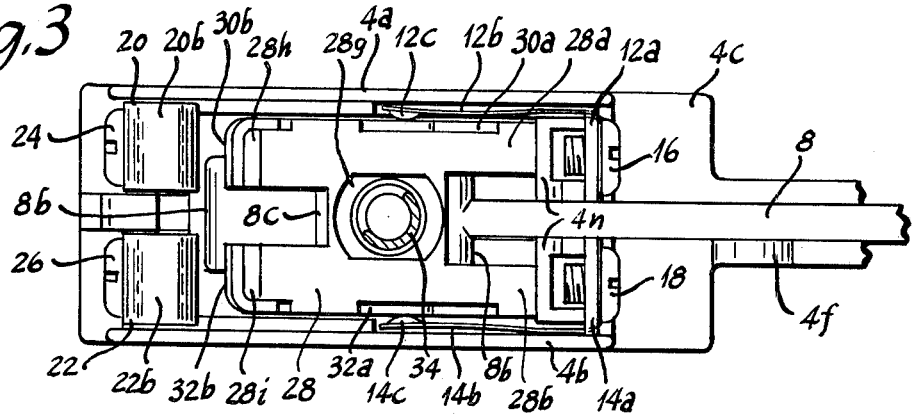
FIG. 3 is a partial cross-sectional view taken along line 3—3 of FIG. 1.
Figure 13:
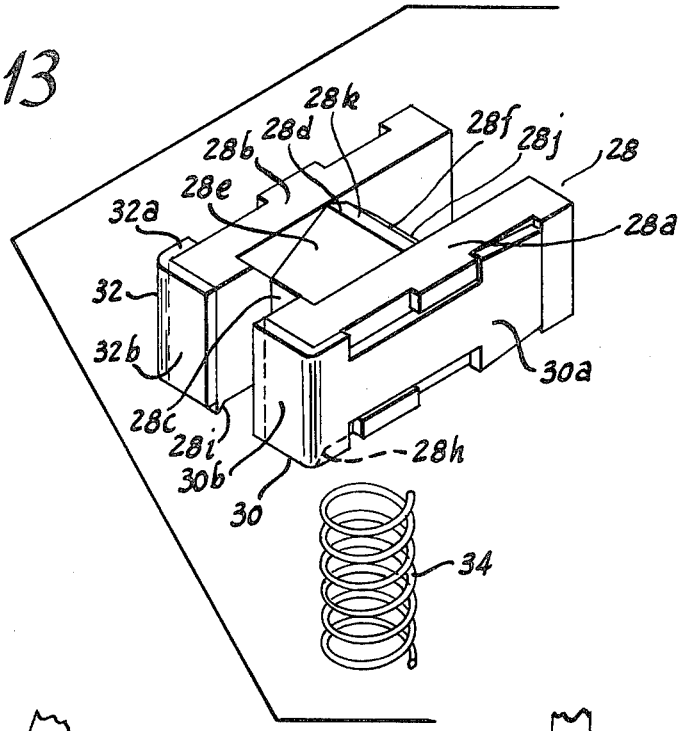
FIG. 13 is an isolated isometric view of the movable contact carrier of FIGS. 1–8.

The switch is provided with an insulating integral H-shaped movable contact carrier 28, FIGS. 2, 3 and 13. The front and rear elongated lateral portions 28a and 28b of the H are notched, FIG. 13, for rigidly mounting and carrying L-shaped movable contacts 30 and 32 respectively. Bumps 12c and 14c of common terminals 12 and 14 are in continuous engagement with legs 30a and 32a, respectively, of the movable contacts. Legs 30b and 32b make and break contact with stationary contact portions 20c and 22c as will be more fully described hereinafter.

The bight 28c of the H extends between portions 28a and 28b and has an apex 28d formed on the top thereof by inclined camming surfaces 28e and 28f meeting thereat, FIG. 4. These camming surfaces are traversed by a cam 8c integrally extending downwardly from the underside of box-like portion 8b of rod 8. The carrier is centrally biased upwardly by a helical compression spring 34 bearing between the carrier and bottom wall 6 with its lower end seated in a cylindrical recess 6c in bottom wall 6 and its upper end seated in a cylindrical recess 28g formed in the underside of bight portions 28c of the carrier, FIG. 4. Spring 34 is under tension and biases the carrier upwardly so that either surface 28e or surface 28f of the bight of the H-shaped carrier is in engagement with cam 8c.

Figure 6:
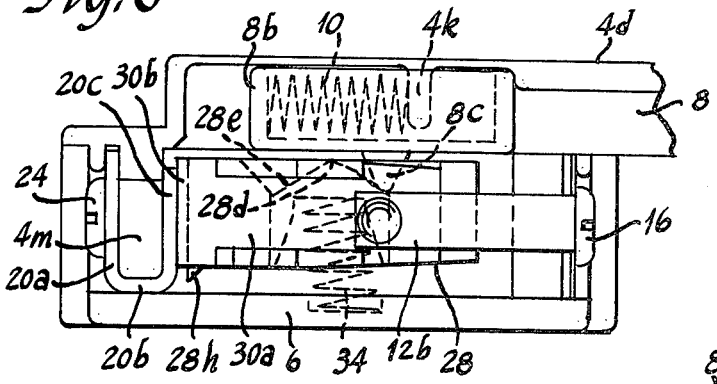
FIGS. 6–8 are partial front elevational views of the contact mechanism of FIG. 1 and sequentially show the contact action.

The preferred embodiment thus comprises a double-pole single throw trigger switch. FIG. 4 shows the switch in an open position with the trigger released and the carrier in its rightmost position with righthand ends of portions 28a and 28b stopped against right side wall 4n of the housing. FIG. 6 shows the switch in a closed position with the trigger depressed and the carrier in its leftmost position with legs 30b and 32b of the movable contacts engaging portions 20c and 22c, FIG. 2, of the stationary contacts. In the closed position, the circuits of the two poles are as follows: (for the front pole) screw 24, stationary contact 20, movable contact 30, common terminal 12, and screw 16; and (for the rear pole) screw 26, stationary contact 22, movable contact 32, common terminal 14, and screw 18.

Figure 5:
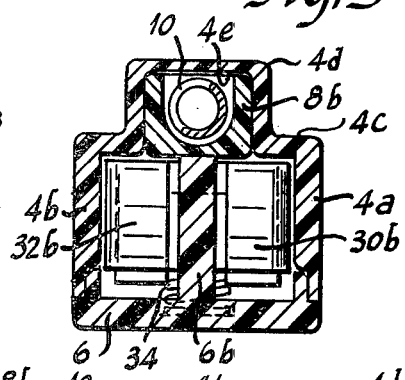
FIG. 5 is a cross-sectional view taken along line 5—5 of FIG. 1.

Operation of the switch will now be described with reference to FIGS. 4, 6, 7 and 8. Referring to FIG. 4, as the trigger is depressed, cam 8c moves rightwardly, traversing slope 28e of the carrier to cam the carrier downwardly against the bias of spring 34. The right side of the carrier abuttingly slides downwardly along right wall 4n of the housing. When cam 8c crosses apex 28d of the carrier, the carrier snaps laterally leftwardly due to the release of stored energy of spring 34 to close the movable and stationary contacts, FIG. 6, thus affording snap-action overcenter contact actuation. When the carrier is snapped leftwardly, movable contact portions 30b and 32b, FIG. 5, buttingly strike stationary contact portions 20c and 22c somewhere in the middle thereof and then slide upwardly therealong to the position shown in FIG. 6, thus affording butting and sliding contact closure.

Upon release of the trigger, cam 8c moves leftwardly, cammingly depressing the carrier downwardly as the cam traverses slope 28f, FIG. 6. During this downward movement of the carrier movable contact portions 30b and 32b abuttingly slide downwardly along stationary contact portions 20c and 22c, whereby to shear welds or frictional attachments, etc., which may have formed therebetween.

Formed on the bottom left of the carrier are a pair of downwardly extending pointed protrusions 28h and 28i, FIGS. 6 and 13, which act as fulcrums. These fulcrums 28h and 28i are formed on the undersides of portions 28a and 28b, FIG. 6, respectively. During the downward movement of the carrier in response to leftward movement of the cam, FIG. 7, the fulcrums strike bottom wall 6 before the cam crosses apex 28*d* as it leftwardly traverses slope 28*f*. After the fulcrums strike the bottom wall, further leftward movement of the cam towards the apex (i.e. further release of the trigger) causes the carrier to pivot clockwise about the fulcrums, FIG. 8, because a moment arm is formed from the fulcrums to the point of carrier-cam engagement whereby a torque is applied by the cam to the carrier about pivots 28*h* and 28*i*. This torque breaks the movable and stationary contacts apart to enhance crisp, clean, non-teasing, non-bouncing, snap-action opening thereof when the cam crosses the apex such that the carrier will snap rightwardly to the "open" position shown in FIGS. 1 and 4. Spring 10 is made of sufficient strength to insure leftward movement of the cam and thus assure application of said torque.

It has been found in comparative tests between switches with fulcrums and switches without fulcrums that the switches with fulcrums consistently performed better. Oscilloscope studies of repeated switch operations show crisp, clean breaking of the contacts in those switches having fulcrums. However, in those switches not having fulcrums, the oscilloscope showed irregular current flow on break, and indicated slow break, arcing and resultant pitting of the contacts, and ocassionally a momentarily delayed opening of the contacts.

The theoretical reasons for the superior performance of those switches with fulcrums is not fully understood, but it is believed that a combination of factors are involved.

One factor is the positive direct force applied to the carrier by the cam in the form of torque to break the contacts apart, without relying solely on the stored energy of spring 34. Without the fulcrums, the carrier would continue sliding downwardly until the cam crossed the apex, whereafter the butting engagement of the contacts is broken only by the force of spring 34. The fulcrums enable a direct mechanical force to be applied to break the contacts, thus affording a "positive-off" feature. This "positive-off" torque is especially important for breaking welds or other frictional attachments between the contacts. For example, at the beginning of the downward stroke of the carrier, FIG. 6, tack welds, etc., may be formed between the contacts. The initial shearing force of the downward movement of the carrier will break such tack welds and thus break the initial static engagement of the contacts; but during the sliding kinetic engagement of the contacts as the carrier moves downwardly, welds may reform or the prior tack welds may have moltenly flowed down or with the contact surfaces such that at the bottom of the downward stroke of the carrier, such welds may prevent or delay disengagement of the contacts if the only disengaging force is that supplied by spring 34. The fulcrums, however, enable the application of operator force to positively break the contacts apart and apply a tensile stress on any welds formed between the contacts whereby to break such welds remaining at the bottom of the carrier stroke.

Another factor in the superior performance of switches with fulcrums is the desired amount of sliding contact engagement provided thereby. In electric switches, a certain amount of sliding and wiping is desirable; however, too little sliding is insufficient to keep the contact surfaces clean, and too much sliding causes excessive wear and shortened life. The fulcrums of the present invention afford a desirable amount of sliding and wiping by limiting the downward travel of the carrier. For example, in some of the switches tested without fulcrums, the total up-down linear travel of the movable contact along the stationary contact was 0.100 in. It was found that this much travel was too much and caused frictional wear to form detents, grooves, cavities, etc., in the contacts, especially at the bottom of the stroke, such that, for example, the movable contacts may become lodged in a worn groove formed in the stationary contacts and prevent crisp disengagement thereof as the cam crosses the apex; or for example, material may accumulate near the bottom of the stationary contacts to form a ledge which impedes disengaging movement of the movable contacts. Non-smooth contact surfaces may also result from such excessive wear, thus causing non-flush contact disengagement and resultant burning, pitting and arcing of the contacts as they separate, compounding the aforenoted problems. The fulcrums may, for example, have a height of 0.050 in. to reduce contact travel to 0.050 in., and these switches exhibited superior performance, even after numerous and repeated operations. The fulcrums reduce travel so as to minimize excessive wear while at the same time permitting desirable wiping action. The formation of grooves, detents, etc., is greatly diminished, and even if there is some frictional lodging of the movable to the stationary contacts at the bottom of the stroke when the fulcrums strike the bottom wall, FIG. 7, the contacts will be torqued apart, FIG. 8, as the cam continues along slope 28*f* towards the apex.

The linear up-down travel of the movable contacts may further be limited by a small nub, not shown, formed on the upper left of the carrier to strike top wall 4*c* of the housing and limit the upward travel of the carrier. In the above cited example, switches having a 0.010 in. nub, and thus 0.040 inch linear up-down travel of the contacts, were also tested and exhibited superior performance. It is of course to be recognized that the tolerances and dimensions given herein are only exemplary, not limiting.

Besides the fulcrum effectuated torque, it is worthy to note the other contact breaking forces afforded by the present invention, specifically those occuring before the fulcrums strike the bottom wall, i.e. those tending to break the static engagement of the contacts at the top of the carrier stroke just at the time of release of the trigger, and those acting during the downward stroke of the carrier before the fulcrums strike the bottom wall; these forces are shear, momentary torque, and torsion. The shearing force between the contacts is caused by the downward movement of the carrier as noted above. If the shearing force does not instaneously break tack welds, etc., there may be exhibited a momentary torque about such tack weld wherein a moment arm is formed from the tack weld, or other point of static attachment, to the point of cam-carrier engagement whereby to momentarily pivot the carrier clockwise about the weld or attachment until broken and the carrier starts or resumes its downward travel. This momentary torque is especially helpful in the case of stronger welds. A third force which may be at work is torsion about one pole which may be welded or hung-up while the other pole is free. Viewing FIGS. 2 and 13, it is seen that upon break, a three-legged stool principle is involved wherein the cam engages the bight 28*c* of the H-shaped carrier to form the point at which force is applied such that if the left end of elongated portion 28*b* is hung-up and won't move downwardly (e.g. contacts 22 and 32 are welded) while the left end of elongated portion 28*a* is free to move downwardly, then the carrier will pivot about an axis coaxial with portion 28*b* whereby to effect a torsional twisting of movable contact portion 32*b* with respect to stationary contact portion 22*c* and thus break welds or frictional attachments formed therebetween. Thus, if one pole of the switch welds or hangs-up, a torsional or twisting force thereabout will result due to the point of cam-carrier engagement being offset from the axis of said torsional turning. At any given instant of time before the fulcrums strike the bottom wall, any of the above-noted forces of shear, momentary torque, and torsion may be acting, either alone or in combination with one or both of the remaining forces. It is thus seen that at the top of the carrier stroke, FIG. 6, and during the downward movement of the carrier, static contact engagement is broken by torsion and/or momentary torque and/or shear, all under the influence of direct mechanical force of the cam on the carrier without relying on spring 34, whereby to further diminish the possibility of switch failure in the "on" position.

Figure 7:
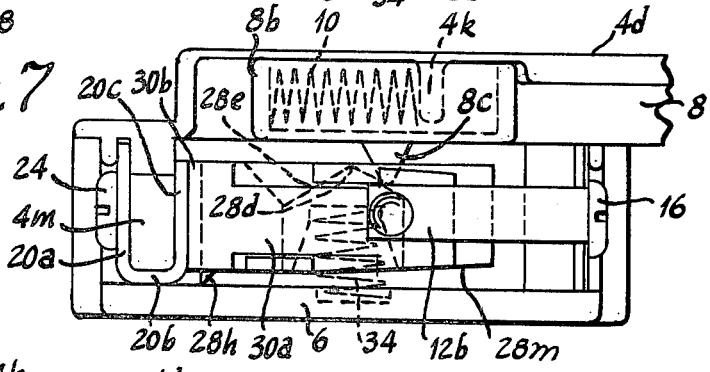
Figure 8:
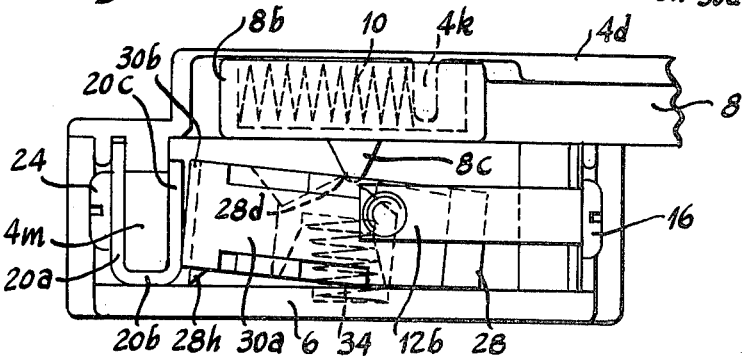

In order to compensate for the slight increase in feedback resistive force when the fulcrums strike the bottom wall, compound slopes may be formed on the carrier leading to the apex. For example, surface 28*f* may comprise a first inclined surface 28*j*, and an second inclined surface 28*k* leading to the apex, surface 28*k* having a shallower slope or less angular inclination from the horizontal than surface 28*j*. Referring to FIGS. 6–8, when the trigger is released, cam 8*c* moves leftwardly under the influence of return spring 10. When the fulcrums strike the bottom wall, the carrier begins to pivot clockwise, FIG. 7, thus pivoting surface 28*j* to an even steeper inclination with respect to the horizontal. If surface 28*f* were of singular inclination, the cam would experience a stronger resistive force against leftward movement thereof when the fulcrums strike the bottom wall due to the steeper slope to be traversed as the carrier pivots. In order to compensate for this increased force necessary to overcome the additional feedback resistance, sloped surface 28*k* is made shallower, or less inclined, and arranged such that when the fulcrums strike the bottom wall, the cam is simultaneously passing from surface 28*j* to surface 28*k* such that the cam experiences relatively the same sloped inclination even upon pivoting of the carrier. The increase in force upon fulcrum-bottom wall engagement is small, but in the particular embodiment disclosed having an overhanging trigger using a return spring 10, it is deemed desirable to provide such compound slope, especially if the strength of spring 10 is only slightly greater than that necessary to torque the carrier (e.g. soft trigger applications), whereby to minimize any increase in force during release of the trigger. Sloped surface 28*e* may also be formed with a compound slope if it is desired to compensate any increase in resistive force during trigger depression. The increase in resistive feedback force for either direction of movement of the cam is only slight, and the provision of a compensating compound slope is discretionary.

Rounded movable contact portions 30*b* and 32*b* are shown in FIGS. 1–5, and straight-edge movable contact portions are shown in the simplified drawings of FIGS. 6–8 as a variation. Rounded contacts are preferred, but other configurations may be used.

An alternate embodiment of the present invention is shown in FIGS. 9–12 disclosing a double-pole double-throw toggle lever switch. A housing 36 has front and rear walls 36*a* and 36*b*, and left and right side walls 36*c* and 36*d*, FIG. 11. The open top of the housing is closed by a cover 38 having sides hooked around notches 36*e* and 36*f* in the side walls of the housing for rigidly securing the cover thereto, FIGS. 9 and 12. The cover has a central aperture over which a cylindrical bushing 40 is mounted which in turn pivotally mounts a toggle lever 42 in a well known manner. The toggle lever pivots in the plane of the page, as viewed in FIG. 12, about axis 44 which is normal to the page. The open bottom of the housing is closed by a bottom wall or base 46.

Figure 10:
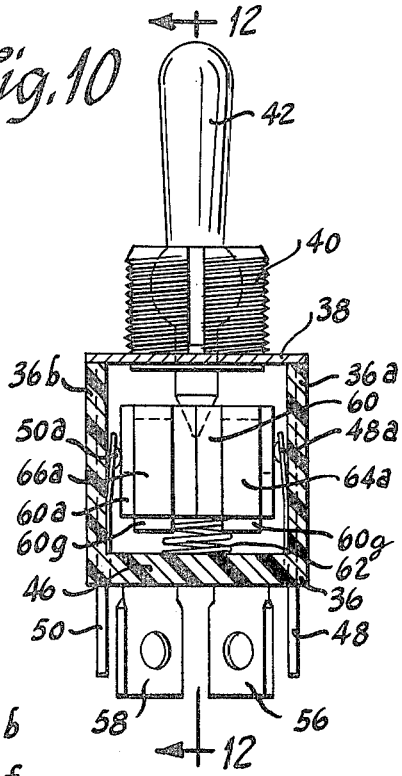
FIG. 10 is a cross-sectional view taken along line 10—10 of FIG. 9.
Figure 11:
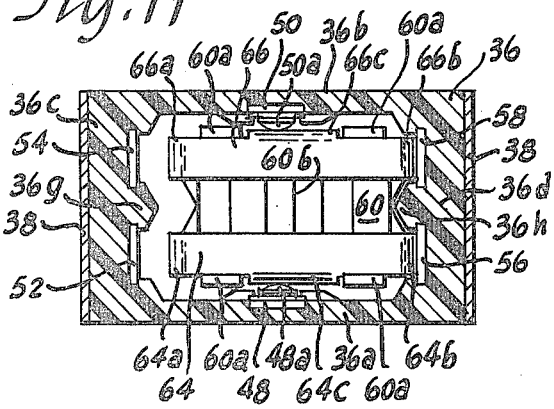
FIG. 11 is a cross-sectional view taken along line 11—11 of FIG. 9.

Mounted centrally to bottom wall 46 are common contact terminals 48 and 50, FIGS. 10 and 11, which extend upwardly internally of the housing adjacent front and rear walls 36*a* and 36*b*, respectively. These common terminals have outer portions for circuit connection. The inner portions are coined and biased inwardly, FIG. 10, with bumps 48*a* and 50*a* formed near the ends for continuous engagement with movable contacts, described hereinafter.

Mounted to the left and right side walls of the housing are stationary contacts 52, 54 and 56, 58, respectively, FIG. 11. Each of the stationary contacts has an external portion for circuit connection, FIGS. 9, 10, 12. Each of the stationary contacts has an interior portion extending vertically upwardly into the housing abutting adjacent a side wall and isolated from the other contact on the same side wall by partitions 36*g* and 36*h* of the housing, FIG. 11.

A movable contact carrier 60, similar to carrier 28 of the aforedisclosed trigger switch, is disposed within the housing and is biased upwardly by spring 62 bearing between the carrier and the bottom wall. Rigidly mounted to the carrier by a plurality of notches and ribs 60*a* are movable contacts 64 and 66. These contacts extend along the top of the carrier, FIG. 11, near the front and rear thereof, and have downwardly bent end portions 64*a*, 64*b*, FIG. 9, and 66*a*, 66*b*, FIG. 12, for making contact with stationary contacts 52, 56, 54 and 58, respectively. The movable contacts also have downwardly bent central portions 64*c* and 66*c* which extend partway down adjacent the front and rear, respectively, of the carrier to continuously engage bumps 48*a* and 50*a*, respectively, of the common terminals. When carrier 60 is in the rightmost position, FIGS. 9 and 11, one pole of the switch is completed through common terminal 48, bump 48*a* (FIGS. 10 and 11), movable contact portion 64*c*, movable contact portion 64*b* (FIGS. 9 and 11) and stationary contact 56, and the other pole is completed through common terminal 50, movable contact 66 and stationary contact 58. When the carrier is in the leftmost position, one pole is completed through common terminal 48, movable contact 64 and stationary contact 52, and the other pole is completed through common terminal 50, movable contact 66 and stationary contact 54.

Figure 12:
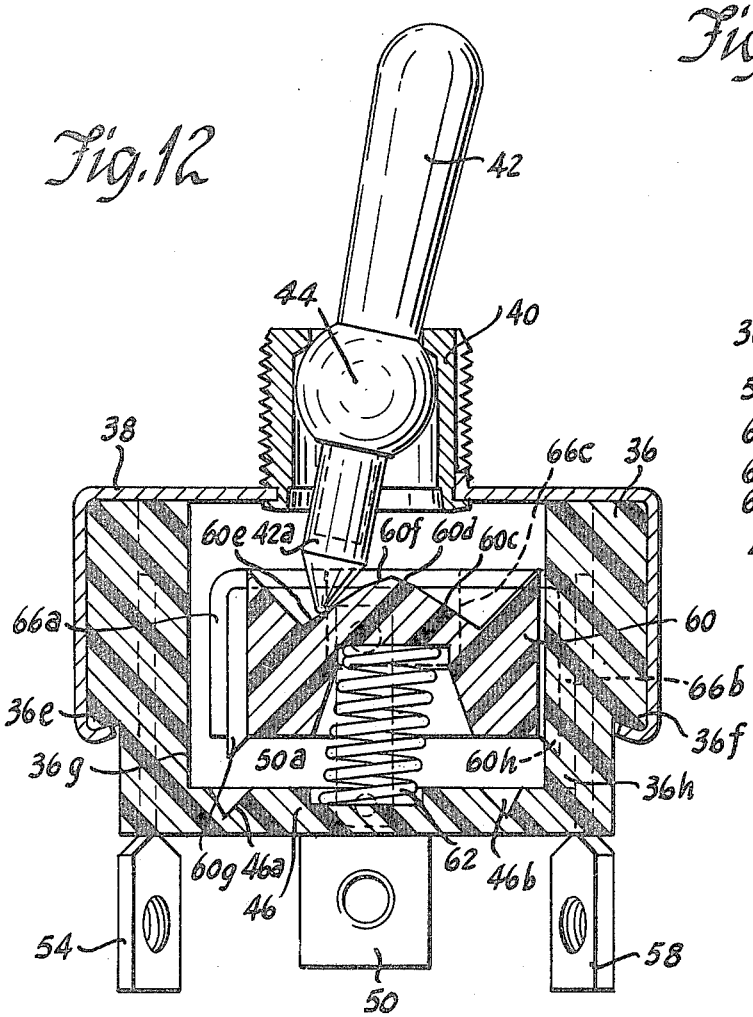
FIG. 12 is a cross-sectional view taken along line 12—12 of FIG. 10.

On the top of the carrier, between the movable contacts, FIG. 11, there are formed a pair of inclined camming surfaces leading to an apex 60*b*, FIG. 12. Each camming surface has a compound slope formed by the surfaces 60*c*, 60*d* on one side of the apex, and 60*e*, 60*f* on the other side. The toggle lever has a cam 42*a* formed on the bottom thereof for engaging the camming surfaces of the carrier. The carrier has fulcrums 60*g* and 60*h* formed on left and right undersides thereof, FIG. 9, to provide a positive torque for both throws of the switch as will presently be described.

Figure 9:
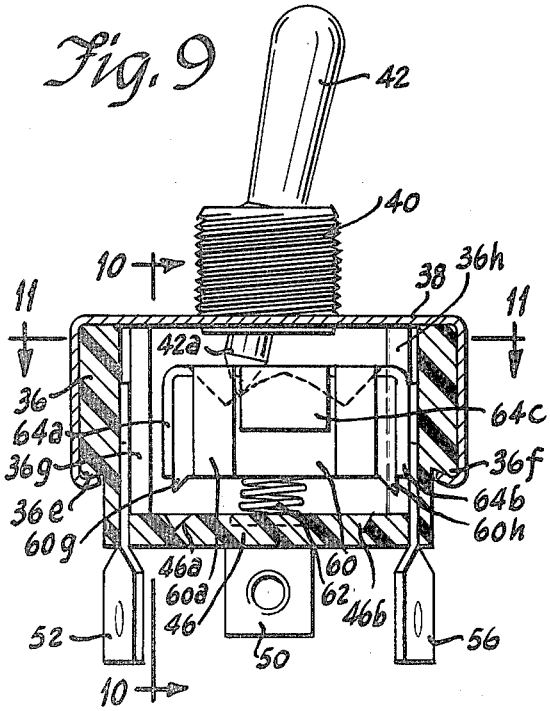
FIG. 9 is a front elevational view of an alternate embodiment of a switch constructed in accordance with the invention, with the front wall removed.

Referring to FIG. 9, as the toggle lever is pivoted counter clockwise, cam 42*a* moves rightwardly in an arc and traverses inclined camming surface 60e of the carrier thereby depressing the carrier downwardly against the bias of spring 62, whereby movable contact portions 64b and 66b slide downwardly along stationary contacts 56 and 58, respectively. When fulcrum 60h strikes the bottom wall, continued pivoting of the toggle lever causes the carrier to pivot counterclockwise about fulcrum 60h due to the torque applied thereto through the moment arm formed between the fulcrum and the point of cam-carrier engagement. A cavity 46a is formed in the bottom wall to allow clearance of the other fulcrum 60g during pivoting of the carrier. During pivoting of the carrier, the cam 42a traverses the lesser inclined surface 60f whereby to afford constant finger pressure on the toggle lever prior to trip point; such compound slope is discretionary, however, because the increase in resistive force when the fulcrum strikes the bottom wall is only nominal and is usually imperceptible. When the cam crosses the apex, the carrier snaps laterally leftwardly and upwardly to close the contacts on the left side of the switch in butting and sliding relation.

Clockwise pivoting of the toggle lever causes the same type of action to return the carrier to its rightmost position to open the contacts on the left side of the switch and close the contacts on the right side of the switch. A second cavity 46b is formed in the bottom wall to allow clearance of fulcrum 60h so that the carrier may pivot clockwise when fulcrum 60g strikes the bottom wall as the cam 42a passes from surface 60c to surface 60d of the carrier.

It can easily be appreciated that all of the abovenoted teachings of fulcrum effectuated torque with respect to the single-throw trigger switch are equally applicable to the double-throw toggle switch for each throw thereof. Furthermore the toggle switch also exhibits the same initial breaking of welds or other static or frictional attachments, prior to fulcrum-bottom wall engagement, by torsion and/or momentary torque and/or shear.

While the preferred embodiments have been described in great detail, a fuller appreciation of the simplicity and effectiveness of the present invention may be realized by reference to FIGS. 14–17, depicting the switch in more elemental form. An apexed movable contactor 100 is biased from below by resilient biasing means, such as spring 102, and cammed from above by an operator, such as toggle lever 104, to snap laterally as the apex is crossed by the operator, and includes fulcrum means, such as projections 100a or 100b, for stoppng the downward movement of the contactor before the operator crosses the apex whereby to effect a torque on the contactor as the operator continues toward the apex.

Stationary contacts, such as 110 and 112, may be disposed on either or both sides of the switch. The contactor may itself comprise an electrically conductive member for engaging the stationary contacts, or it may comprise an insulating member having one or more contacts, such as 106 and 108, mounted thereto, or some combination thereof. Furthermore, there need not necessarily be a common terminal as aforedescribed, but for example, two stationary contacts may be situated on the same side of the housing to be bridged by an elongated movable contact upon engagement therewith, to provide, for example a single-pole, single or double throw switch. Numerous contact orientations are possible within the scope of the present invention as will be readily appreciated by those skilled in the art.

Flexibility in choice of operator type is also apparent from the simplified drawings of FIGS. 14–17. Any type of operator which traverses the apex of the contactor to cammingly depress the contactor downwardly, may be used.

Figure 14:
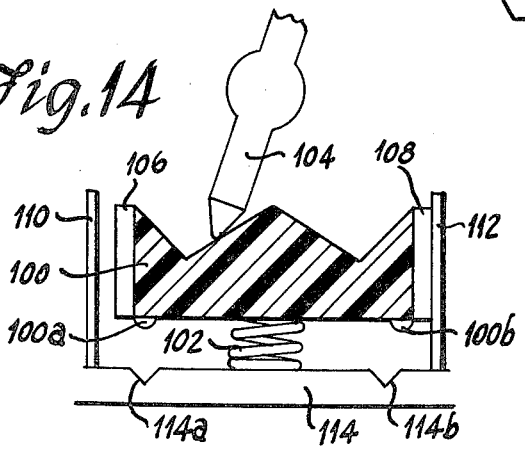
FIGS. 14–17 show the basic elements of the present invention in simplified form, and sequentially illustrate the contact action.
Figure 15:
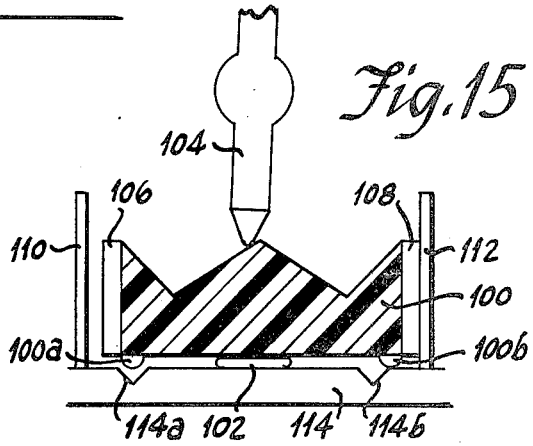
Figure 16:
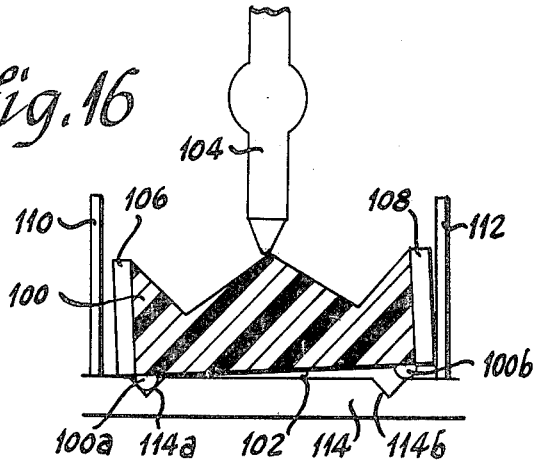
Figure 17:
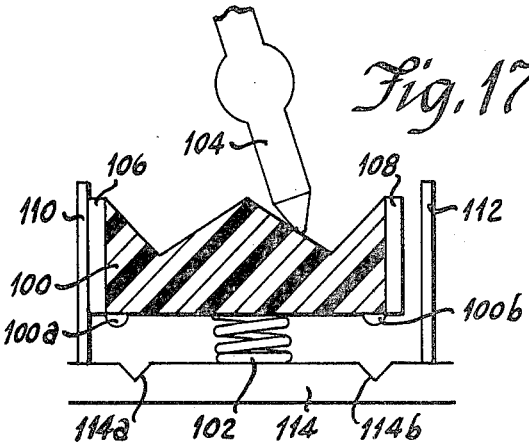

FIG. 14 shows the contactor in its right uppermost stable position with contact 108 statically engaging contact 112. As the operator moves rightwardly, FIG. 15, the contactor is depressed downwardly against the bias of biasing means 102 as the operator traverses the inclined camming surface of the contactor. Before the operator reaches the apex of the contactor, fulcrum means are effective to stop the downward movement of the contactor. Though protrusion 100b extending from the underside of the carrier is shown striking a base 114, FIG. 15, other fulcrum means may be used, for example a protrusion extending upwardly from the base 114 to halt the downward travel of the contactor. The fulcrum means must limit the travel of the contactor such that the downward rectilinear movement thereof is halted before the operator crosses the apex, whereby continued movement of the operator towards the apex exerts a torque on the contactor to pivot it as shown in FIG. 16. This torque is a positive direct force applied by the operator to break the contacts apart without relying on the biasing means 102, thus enhancing snap-action lateral movement of the contactor to the left stable position shown in FIG. 17 when the operator crosses the apex. The fulcrum means thus enables the application of direct mechanical contact-breaking torque, and thus affords a snap-action switch having little possibility of failure in an "on" position.

Cavities 114a and 114b may be provided as needed. For example, assume contacts 108 and 112 are omitted so that contact is made only on the left; fulcrum 100b and cavity 114b may then be omitted, and if desired, cavity 114a may also be omitted (as in the aforementioned trigger switch) because as the contactor moves downwardly and fulcrum 100a strikes the base, the contactor can pivot clockwise until the operator crosses the apex because of the absence of fulcrum 100b. Also, the bottom of the contactor can be tapered upwardly, as is shown in FIG. 7 with the right underside 28m of the carrier tapered upwardly to assure adequate clearance between the carrier and bottom wall for either direction of motion of cam 8c.

It will be appreciated that other modifications and variations are possible, and the invention is to be limited only by the scope of the appended claims.

What is claimed is:

1. In an electric switch comprising an upwardly biased apexed contactor cammed downwardly from above by a movable operator to snap laterally against stationary contact means as the apex is crossed by the operator;

the improvement comprising fulcrum means effective during disengagement of said stationary contact means to stop the downward movement of said contactor before said operator crosses said apex to thereby form a moment arm to the point of operator-contactor engagement such that further movement of said operator towards said apex exerts a torque on said contactor to pivot said contactor away from said stationary contact means until said apex is crossed.

2. A snap-action electric switch comprising in combination:

a housing;

a contactor having an apex and movable between left and right stable positions in said housing;

resilient means biasing said contactor upwardly;

an operator movably mounted to said housing and engaging said contactor to cammingly depress said contactor downwardly against the bias of said resilient means in response to movement of said operator such that said contactor snaps laterally between said stable positions due to the release of stored energy of said resilient means as said apex is crossed by said operator;

stationary contact means mounted in said housing and engaged by said contactor in at least one of said stable positions;

terminal means for circuit connection in at least one of said stable positions; and fulcrum means disposed in said housing and effective to stop the downward movement of said contactor from at least one of said stable positions before said operator crosses said apex to thereby form a moment arm to the point of operator-contactor engagement such that further movement of said operator towards said apex exerts a torque on said contactor to positively pivot said contactor away from said stationary contact means until said operator crosses said apex.

3. The switch according to claim 2 wherein said contactor pivots about an axis orthogonal to said lateral and said downward movements of said contactor.

4. The switch according to claim 2 wherein said contactor and said stationary contact means engage in a vertical plane orthogonal to said lateral and said downward movements of said contactor.

5. The switch according to claim 4 wherein said contactor snaps laterally and upwardly against said stationary contact means in butting and sliding relation.

6. The switch according to claim 5 wherein static engagement of said contactor and said stationary contact means is broken before said fulcrum means effectuated torque by one or more of the combination of forces of shear and momentary torque applied directly to said contactor by said operator, said shear being caused by the downward sliding of said contactor along said stationary contact means and said momentary torque being applied through a moment arm formed from the point of said static engagement to the point of operator-contactor engagement.

7. The switch according to claim 2 wherein said housing has a bottom wall and wherein said fulcrum means comprises one or more projections extending downwardly from said contactor to strike said bottom wall and stop the downward movement of said contactor.

8. The switch according to claim 5 further comprising means limiting the upward movement of said contactor to provide, in combination with said fulcrum means, a desired amount of contact wipe.

9. The switch according to claim 2 wherein said contactor has oppositely inclined camming surfaces meeting at said apex, said operator engaging a camming surface left of said apex when said contactor is in said right stable position and engaging a camming surface right of said apex when said contactor is in said left stable position.

10. The switch according to claim 9 wherein at least one of said camming surfaces has a compound slope such that said operator traverses a surface of substantially uniform inclination notwithstanding said pivoting of said contactor.

11. The switch according to claim 10 wherein said compound slope comprises a first incline extending from said apex to meet a second steeper incline such that said operator passes from said second incline to said first incline as said contactor pivots.

12. The switch according to claim 2 wherein said stationary contact means comprise front and rear spaced contacts lying in a line orthogonal to said lateral and said downward movements of said contactor such that said operator exerts a torsion on said contactor about a lateral axis if said downward movement of said contactor is stopped by static engagement of said contactor and one of said spaced contacts.

13. The switch according to claim 7 comprising a single throw switch wherein said contactor engages said stationary contact means in said left stable position and wherein said one or more projections extend from the left underside of said contactor.

14. The switch according to claim 13 wherein the right underside of said contactor is tapered upwardly.

15. The switch according to claim 7 comprising a double throw switch wherein said contactor engages different members of said stationary contact means in each of said stable positions and wherein said projections extend from the left and right undersides of said contactor and wherein said bottom wall has a plurality of cavities to allow clearance therein of a corresponding projection to permit said pivoting of said contactor when another of said projections strikes said bottom wall.

16. The switch according to claim 2 wherein said terminal means comprises one or more common terminals in continuous sliding engagement with said contactor.

17. The switch according to claim 16 wherein said terminals are coined to provide biased engagement with said contactor.

18. The switch according to claim 2 wherein said contactor comprises a movable contact carrier and one or more movable contacts rigidly mounted thereto.

19. A double-pole single-throw snap-action trigger switch comprising:

a housing including a bottom wall;

a movable contact carrier disposed in said housing and having oppositely inclined camming surfaces meeting at an apex and having right and left stable positions;

resilient means disposed in said housing and biasing said carrier upwardly;

a pair of stationary contacts mounted at the left side of said housing;

a pair of common terminals mounted in said housing;

a pair of movable contacts rigidly carried by said carrier, each of said movable contacts having a first surface in continuous engagement with a respective one of said common terminals and a second surface engaging a respective one of said stationary contacts when said carrier is in said left stable position;

a trigger operator movably mounted to said housing and including a cam engaging the camming surface left of said apex when said carrier is in said right stable position and engaging the camming surface right of said apex when said carrier is in said left stable position, said cam being laterally movable in response to movement of said trigger such that in response to a first direction of movement of said trigger, said cam rightwardly traverses said left camming surface towards said apex depressingly camming said carrier downwardly against the bias of said resilient means, whereupon crossing of said apex by said cam, said carrier snaps laterally and upwardly to said left stable position due to the release of stored energy of said resilient means to close said stationary and movable contacts in butting and sliding relation in a plane of engagement orthogonal to said downward and said lateral movements of said carrier; and one or more fulcrums extending downwardly from the left underside of said carrier such that in response to a second direction of movement of said trigger, said cam leftwardly traverses said right camming surface depressingly camming said carrier downwardly, said movable contacts sliding downwardly along said stationary contacts, said one or more fulcrums striking said bottom wall before said cam crosses said apex to thereby stop the downward movement of said carrier and form a moment arm from said one or more fulcrums to the point of cam-carrier engagement such that further leftward movement of said cam towards said apex exerts a direct torque on said carrier about said one or more fulcrums to positively pivot said movable contacts clockwise away from said stationary contacts about an axis orthogonal to said downward and said lateral movements of said carrier until said cam crosses said apex and said carrier snaps laterally and upwardly to said right stable position, said pivoting occurring without relying on the stored energy of said resilient means whereby to afford a switch having little possibility of failure in an on position.

20. A double-pole double-throw snap-action toggle switch comprising:

a housing including a bottom wall with a plurality of cavities formed therein;

a movable contact carrier disposed in said housing and having oppositely inclined camming surfaces meeting at an apex and having right and left stable positions;

resilient means disposed in said housing and biasing said carrier upwardly;

a pair of spaced stationary contacts mounted at the left side of said housing and a pair of spaced stationary contacts mounted at the right side of said housing;

a pair of common terminals mounted in said housing;

a pair of movable contacts rigidly carried by said carrier, each of said movable contacts having a central surface in continuous engagement with a respective one of said common terminals, a right surface for engaging a respective one of said pair of said right side stationary contacts when said carrier is in said right stable position, and a left surface for engaging a respective one of said pair of said left side stationary contacts when said carrier is in said left stable position;

a toggle lever operator pivotally mounted to said housing and including a cam engaging the camming surface left of said apex when said carrier is in said right stable position and engaging the camming surface right of said apex when said carrier is in said left stable position, said carrier snapping laterally and upwardly due to the release of stored energy of said resilient means as said apex is crossed by said cam; and one or more fulcrums extending downwardly from each of the left and right undersides of said carrier;

such that in response to a first direction of movement of said toggle lever, said cam traverses said left camming surface towards said apex depressingly camming said carrier downwardly from said right stable position against the bias of said resilient means with said right surfaces of said movable contacts sliding downwardly along said right side stationary contacts, said one or more right fulcrums striking said bottom wall before said cam crosses said apex to stop the downward movement of said carrier and form a moment arm from said one or more right fulcrums to the point of cam-carrier engagement such that further movement of said cam towards said apex exerts a direct torque on said carrier about said one or more right fulcrums to positively pivot said movable contacts counterclockwise away from said right side stationary contacts about an axis orthogonal to said downward and said lateraly movements of said carrier until said cam crosses said apex, one or more of said cavities in said bottom wall allowing clearance therein of said one or more left fulcrums as said carrier pivots counterclockwise, said carrier snapping laterally and upwardly to said left stable position when cam crosses said apex from said left camming surface to said right camming surface such that said left surfaces of said movable contacts engage said left side stationary contacts in butting and sliding relation in a plane of engagement orthogonal to said downward and said lateral movements of said carrier;

and such that in response to a second direction of movement of said toggle lever, said cam traverses said right camming surface towards said apex depressingly camming said carrier downwardly from said left stable position against the bias of said resilient means with said left surfaces of said movable contacts sliding downwardly along said left side stationary contacts, said one or more left fulcrums striking said bottom wall before said cam crosses said apex to stop the downward movement of said carrier and form a moment arm from said one or more left fulcrums to the point of cam-carrier engagement such that further movement of said cam towards said apex exerts a direct torque on said carrier about said one or more left fulcrums to positively pivot said movable contacts clockwise away from said left side stationary contacts about an axis orthogonal to said downward and said lateral movements of said carrier until said cam crosses said apex, another one or more of said cavities in said bottom wall allowing clearance therein of said one or more right fulcrums as said carrier pivots clockwise, said carrier snapping laterally and upwardly to said right stable position when said cam crosses said apex from said right camming surface to said left camming surface such that said right surfaces of said movable contacts engage said right side stationary contacts in butting and sliding relation in a plane of engagement orthogonal to said downward and said lateral movements of said carrier.

* * * * *